United States Patent [19]

Op den Velde et al.

[11] 4,397,587

[45] Aug. 9, 1983

[54] METHOD OF CONSTRUCTING AN ARTIFICIAL ISLAND AND ISLAND CONSTRUCTED BY THE SAME

[75] Inventors: Jan Op den Velde, Bussum; Jan B. Elzerman, Amsterdam; Klaas Oterdoom, Bentveld, all of Netherlands

[73] Assignees: Ballast-Nedam Groep N.V.; Amsterdamse Ballast Bagger en Grond (Amsterdam Ballast Dredging) B.V., both of Amstelveen, Netherlands

[21] Appl. No.: 194,225

[22] Filed: Oct. 6, 1980

[30] Foreign Application Priority Data

Aug. 5, 1980 [CA] Canada ..... 357598

[51] Int. Cl.[3] ..... E02D 21/00

[52] U.S. Cl. ..... 405/222; 405/217; 403/195

[58] Field of Search ..... 405/217, 114-118, 405/15-35, 222, 223

[56] References Cited

U.S. PATENT DOCUMENTS

| | | | |
|---|---|---|---|
| 219,899 | 9/1879 | Bangs et al. | 405/32 |
| 465,968 | 12/1891 | Neale | 405/28 X |
| 864,481 | 8/1907 | Neale | 405/116 |
| 1,129,719 | 2/1915 | Parrott | 405/32 |
| 1,146,229 | 7/1915 | Adamson | 405/32 |
| 1,168,547 | 1/1916 | Pedley | 405/15 |
| 1,841,594 | 1/1932 | Dysart | 405/32 |
| 1,847,043 | 2/1932 | Ball | 405/30 |
| 1,973,821 | 9/1934 | Mason | 405/114 |
| 3,731,492 | 5/1973 | Ageer et al. | 405/117 |
| 4,080,793 | 3/1978 | Pulsifer | 405/30 |
| 4,080,797 | 3/1978 | Thompson | 405/217 |
| 4,118,937 | 10/1978 | Mansen | 405/30 |

*Primary Examiner*—Dennis L. Taylor

*Attorney, Agent, or Firm*—Diller, Ramik & Wight

[57] ABSTRACT

An artificial island is constructed by depositing material such as sand, clay or the like on the building site on the bottom and by providing inhibiting means formed by branched, relatively spaced elements positioned on the building site, to reduce the rate of effluence of the material such as sand, clay or the like along the sea bottom.

5 Claims, 10 Drawing Figures

METHOD OF CONSTRUCTING AN ARTIFICIAL ISLAND AND ISLAND CONSTRUCTED BY THE SAME

PRIOR ART STATEMENT

At the time of filing of the application applicants were not aware of any references with regard to this subject.

The invention relate to a method of constructing an artificial island by depositing material such as sand, clay or the like on a building site on the ground and by providing inhibiting means for reducing the rate of effluence of the material such as sand, clay or the like directed along the bottom of the sea.

Such artificial islands are constructed by conveying an amount of material obtained elsewhere, for example, with the aid of a dredger by transport means and by depositing it on the bottom of the sea. The inhibiting means for reducing the rate of effluence along the sea bottom, for example, embankments, artificial sea-weed and the like prevent the quantity of material from settling far away from the building site on the bottom due to kinetic energy. The resultant talus may be protected by sandbags. Although there has always been a tendency to construct an artificial island by means of a minimum amount of material and within the shortest possible period of time having the desired stability for the locally prevailing weather conditions, the known method has the drawback that it requires accurate positioning of the inhibiting means frequently guided by drivers. This is a time-consuming operation and the island to be constructed by said method is particularly expensive. There is, moreover, the risk of inhibiting means getting loose, which results in pollution of the environment if the inhibiting means are made from extraneous substances.

The invention has for its object to construct an artificial island by means of a limited amount of material, which combines a satisfactory stabilibity with a comparatively high steepness of the slope. According to the invention this is achieved in that the inhibiting means for reducing the rate of effluence of material such as sand, clay and the like along the sea bottom are formed by branched, relatively spaced elements disposed on the building site. By disposing said elements on the building site it is ensured on the one hand that a drastic reduction of the rate of effluence of the material such as sand, clay or the like is obtained and on the other hand that said elements operate as reinforcements in the resultant island, so that despite the great steepness of the slope a stable island is obtained. This is particularly important in marine regions of particularly unfavourable weather conditions, for example, due to menacing icefloes, drift ice, icebergs and the like. In such regions an island that can be made from a small amount of material is of essential importance, since there the workable season includes only a few months of a year. A further problem in such regions is, that all materials, probably with the exception of sand, clay and the like, have to be supplied over comparatively large distances. Moreover, the materials used have to be harmless to the environment.

In order to satisfy said requirements, said elements are in accordance with the invention, of natural material, for example, vegetal material, particularly wood. Said elements are preferably formed by trees. Trees are found in large regions throughout the world. Even in arctic regions trees can be had at comparatively short distances. In order to deposit trees on the sea bottom, they are loaded.

For conveying the material it is preferred to employ a hopper-barge dragline dredger for loading ground material at a remote place. Material can be supplied to the building site and discharged there by means of hopper barges discharging at the bottom. Particularly when discharging with the aid of the latter hopper barges the material attains high kinetic energy. In order to prevent the material from being deposited far away from the building site on the bottom strong inhibiting means are required.

Preferably during the deposition of the material, such as sand, clay or the like or, when the material, for example, sand, clay or the like, is discontinuously deposited, during the intervals elements are repeatedly put down on the part of the island already formed. The effect described above is, therefore, obtained in all stages of the island formation and the final island will have the desired reinforcement throughout its height. Said elements are mainly deposited on the slope of the formed part of the island. On the slope the need for reinforcement is greatest, whilst, of course, also in these areas inhibition of the rate of effluence is of paramount importance.

The invention will be described more fully hereinafter with reference to the accompanying drawings.

The drawings show in:

FIG. 1 the mode of supply of material with the aid of a pressure conduit,

FIG. 2 a hopper barge for supplying material such as sand, clay or the like, FIG. 3 the mode of supply of the material such as sand, clay or the like from a remote stock on board a ship or on the mainland, FIG. 4 a plan view of a tree-trimmed artificial island under way of construction, FIG. 5 a plan view of an annular, tree-trimmed artificial island under way of construction, FIG. 6 the lowering of trees for the construction of an artificial island in accordance with the invention, FIG. 7 a loaded tree for use in the method in accordance with the invention, FIG. 8 an elevational view of the artificial island in accordance with the invention under way of construction, FIG. 9 an alternative mode of lowering and positioning of trees and FIG. 10 an elevational view of an island having inhibiting reinforcement in the form of bundled faggots.

The trees used in the method of constructing an artificial island may be separately loaded, for example, by means of a block 1 of concrete (FIG. 7) or be tied together with several trees or faggots to a line 2, which is locally loaded by concrete blocks 3, 4 (FIGS. 9 and 10). The trees are lowered on an artificial island under way of construction. The trees may occupy the whole surface of the island (FIG. 4) or an annular part thereof (FIG. 5), particularly in those areas where the rate of effluence of the material such as sand, clay or the like has to be drastically reduced.

FIG. 1 shows a pressure conduit 7 by which material obtained elsewhere is supplied. The position of the pressure conduit 7 is determined from a vessel 8.

FIG. 2 shows a hopper barge 6 with the aid of which material such as sand, clay or the like is deposited on the bottom, where the trees already present are covered. The final island will comprise on the one hand trees completely embedded in the material such as sand, clay or the like and on the other hand trees partly emerging from the sand, clay or the like.

Figure 1:
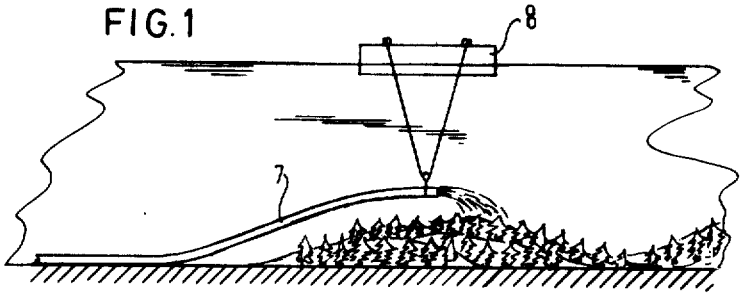
Figure 2:
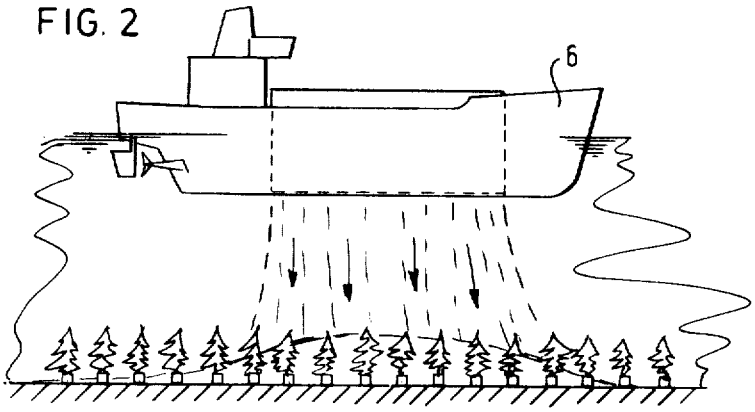
Figure 3:
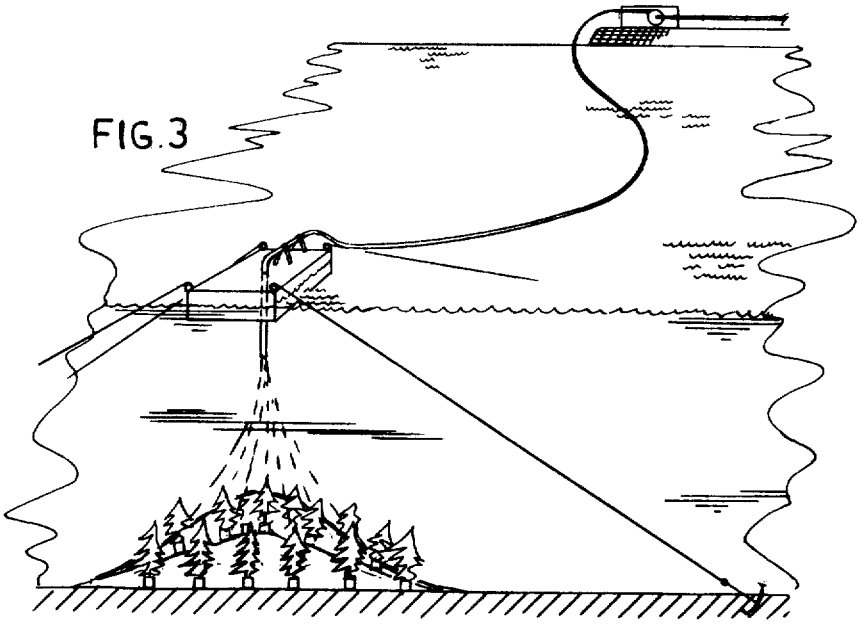
FIG. 3 illustrates a different mode of applying the material for the artificial island.
Figure 4:
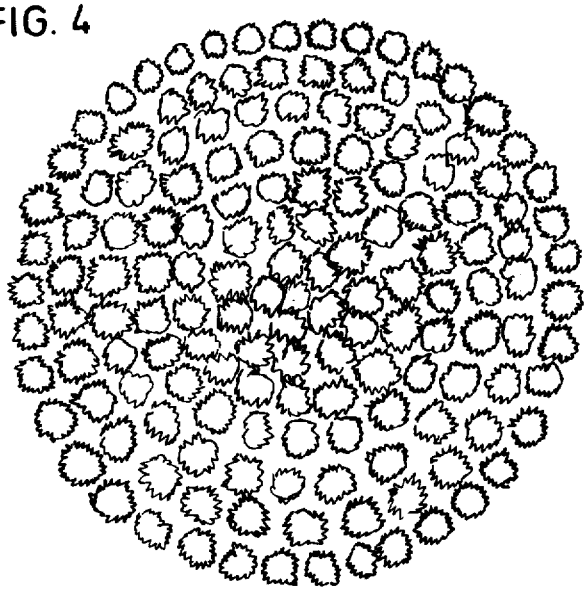
Figure 5:
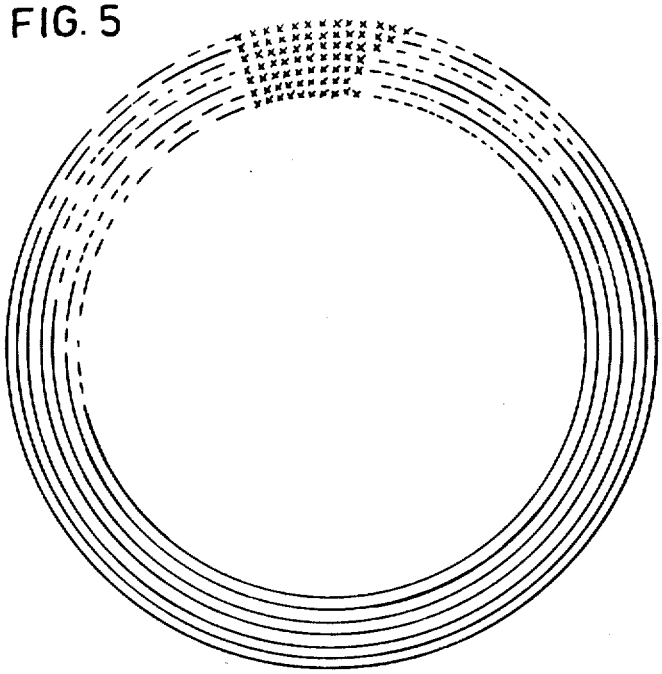
Figure 6:
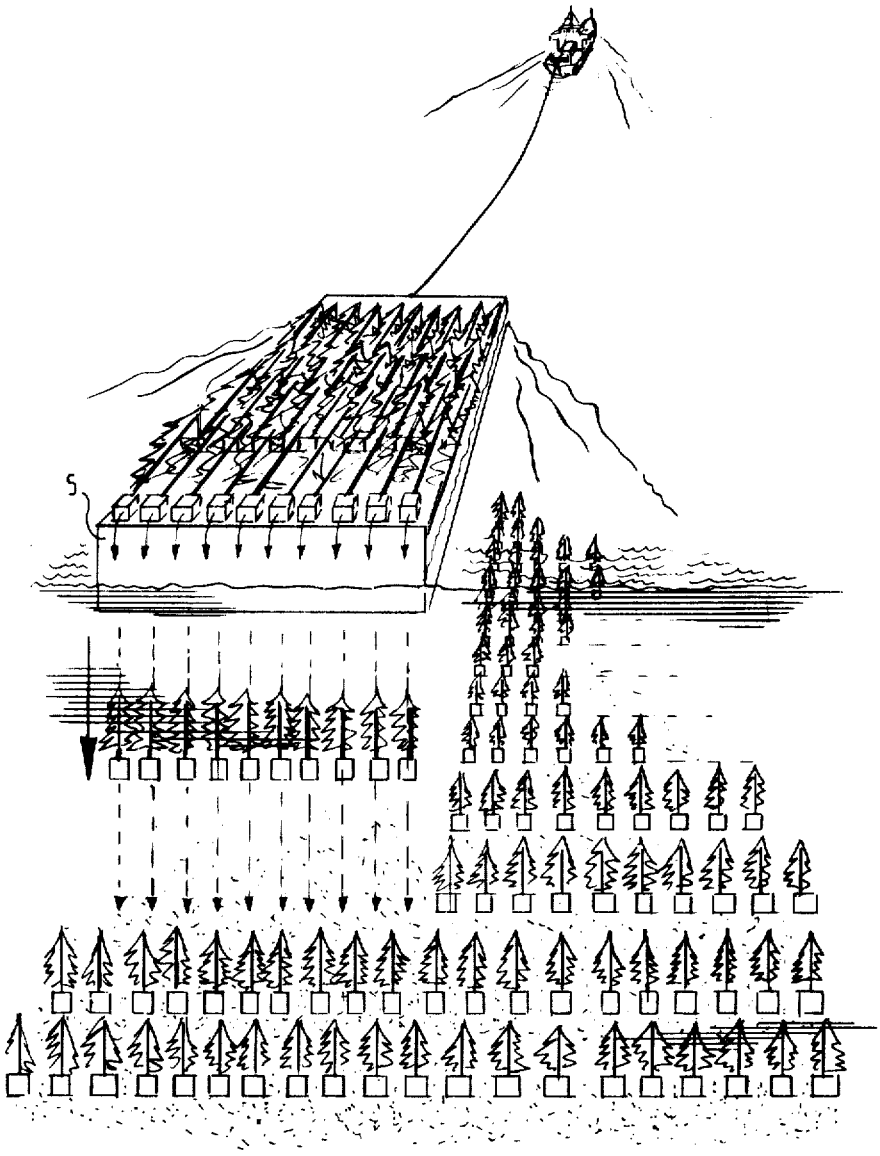
FIG. 6 shows a hopper barge 5 with the aid of which the trees are discharged on the island under construction.
Figure 7:
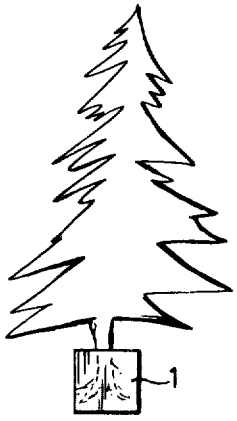
Figure 8:
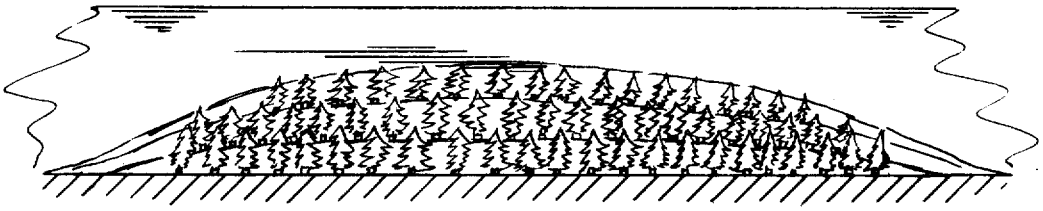
Figure 9:
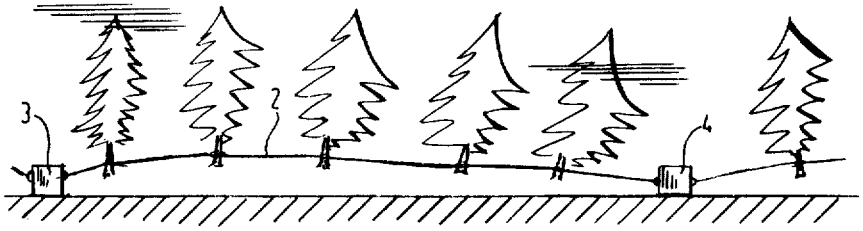
Figure 10:
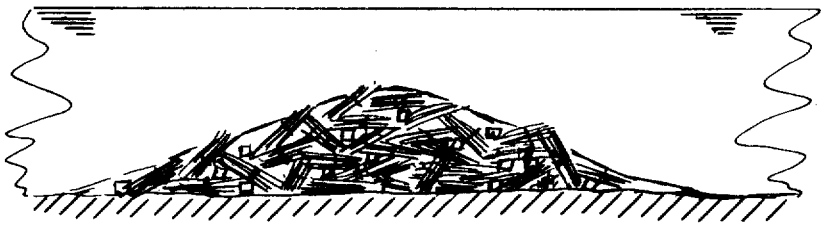

What we claim is:

1. A method of constructing an artificial island by depositing material such as sand, clay or the like on the buildiing site on an under water bottom and by providing inhibiting means formed by branched elements positioned on the building site for reducing the rate of effluence of the material such as sand, clay or the like along the under water bottom, wherein before lowering the branched elements, at least some of said branched elements are weighted with a load adjacent their bottom ends, characterized in that in a step (a) the loaded branched elements are dumped in a standing position from a floating barge onto the under water bottom and that in a subsequent step (b) the material is dumped over said branched elements.

2. A method as claimed in claim 1 wherein loaded branched elements are dumped in subsequent rows.

3. A method as claimed in claim 1 or 2 wherein an artificial island is built up from layers each layer being deposited in steps (a) and (b).

4. A method as claimed in claim 1, 2 or 3 characterized in that a group of branched elements is connected to a line which is locally loaded at at least two spots.

5. The method of constructing an earth mass from the bottom up, particularly in the open sea, with a minimum amount of material, which comprises the steps of:

(a) forming a predetermined array of weighted, branched elements on the sea bottom by dumping such weighted elements overboard at sea level in conformity with such array, said predetermined array being of sufficiently small area as to require a minimum amount of material for the construction;

(b) dredging spoil from the sea bottom at a site remote from said array and discharging such spoil to settle downwardly within the area encompassing said array whereby there is minimal spreading of spoil beyond the confines of the array;

(c) forming a further array of weighted, branched elements on the spoil deposited in step (b) by dumping such weighted elements overboard at sea level in conformity with such further array, said further array having a boundary just inside the boundary of the previous array;

(d) dredging more spoil as in step (b) and discharging it onto the array of step (c); and (e) repeating steps (c) and (d) until the construction reaches a desired level.

* * * * *